United States Patent [19]

Sternberg

[11] Patent Number: 4,744,689

[45] Date of Patent: May 17, 1988

[54] BINDER WITH CLOSURE

[76] Inventor: Adam Sternberg, 380 Fulton St., Apt. D-1, Farmingdale, Long Island, N.Y. 11735

[21] Appl. No.: 777,369

[22] Filed: Sep. 18, 1985

Related U.S. Application Data

[63] Continuation-in-part of Ser. No. 762,102, Aug. 2, 1985, abandoned.

[51] Int. Cl.[4] ..... B42F 13/16; B42D 3/00; B42D 3/10

[52] U.S. Cl. ..... 402/73; 402/70; 402/502; 281/29

[58] Field of Search ..... 281/18, 20, 29, 33; 402/70, 73, 502, 80 R, 4; 190/11, 900, 901, 902

[56] References Cited

U.S. PATENT DOCUMENTS

| | | | |
|---|---|---|---|
| 1,329,910 | 2/1920 | Lambert | 402/70 |
| 1,711,894 | 5/1929 | Lawrence | 402/70 |
| 1,918,773 | 7/1933 | Morehouse | 402/70 |
| 2,333,523 | 11/1943 | Cohun | 190/902 X |
| 2,804,872 | 9/1957 | Kraut | 402/75 |
| 4,515,493 | 5/1985 | Radovich | 402/70 |
| 4,531,764 | 7/1985 | Chang | 402/80 P |
| 4,588,321 | 5/1986 | Egly | 402/502 X |

FOREIGN PATENT DOCUMENTS

| | | | |
|---|---|---|---|
| 783401 | 4/1968 | Canada | 281/29 |
| 23010 | 10/1907 | United Kingdom | 402/74 |
| 0481799 | 3/1938 | United Kingdom | 190/900 |

*Primary Examiner*—Howard N. Goldberg
*Assistant Examiner*—Taylor J. Ross
*Attorney, Agent, or Firm*—Jordan B. Bierman

[57] ABSTRACT

In a standard binder, the improvement comprising the provision of a closure connected by a hinge to one of the covers at an outside edge thereof, a ledge on the closure and having an upper surface, the surface located at a distance from the cover to which the closure is connected approximately equal to the distance between the inner faces of the two covers at the spine, whereby the covers are maintained in substantially parallel relationship to each other regardless of the amount of paper in the binder. In alternate forms of the binder, a flap is provided which is releasably secured to one of the covers. The flap may overlie or be tucked under the other cover, and the closure and ledge are so arranged that the covers are approximately parallel when the binder is closed and secured.

38 Claims, 3 Drawing Sheets

BINDER WITH CLOSURE

This application is a continuation-in-part of copending application Ser. No. 762,102, filed Aug. 2, 1985, now abandoned.

The present invention is directed to the field of binders and, more specifically, to a binder which opens to allow insertion or removal of sheet material and closes to hold material in place and which will assume a substantially rectangular cross-sectional shape when closed.

For ease in turning pages, especially a ring binder, is usually substantially wider than the thickness of the paper to be held. As a result, even when the binder is relatively full, the edges of the covers remote from the rings are substantially closer together than the spine and the cross-section of the binder becomes triangular.

This is not desirable, since such shaped binders will not readily and securely fit on a bookshelf. In addition, if it is desired to stack the binders, the alternate ones must be reversed in order to prevent the upper ones from sliding off the lower ones.

Such binders find substantial use in publications which must be updated at intervals. In particular, legal treatises, computer manuals, etc. fall into this category. Thus, it is among the objects of the present invention to provide a means whereby a ring binder can be substantially rectangular in cross-section, regardless of the amount of paper contained therein. In fact, such a binder would be rectangular even when empty.

This problem has previously been "solved" by the provision of a sleeve which fits over the edge of the binder remote from the rings. In essence, it means putting the binder in a box having an opening at the side at which the spine of the binder is located. While this is satisfactory in operation, it is expensive (since it requires an entire extra piece to be included with the binder) and is cumbersome to open and close. Moreover, the covers can easily be lost or misplaced, especially when the user has more than one volume open at the same time. The present invention is intended to remedy the foregoing defects.

The invention will be described with reference to a ring binder, but it is understood that it applies to any releasable retaining means, so long as the spine is substantially wider than the thickness of the sheets held therein. In practicing the present invention, there is provided a ring binder comprising a spine, a first cover connected to the spine at one edge thereof by a first hinge. A second cover is also provided and is connected to the spine at a second edge by a second hinge. The two edges are spaced apart by the width of the spine.

The rings are located between the inner faces of the two covers and are preferably secured to the inner face of one of the covers. Advantageously, they are of the type which opens for the insertion or removal of previously perforated sheets and closes to secure them within the binder.

A closure is connected to one of the covers by a third hinge located on any of the three outer edges thereof, although it is preferable that it be on the edge remote from the rings and parallel to the first and second hinges. A ledge is provided on the closure and has an upper surface. This surface is located at a first distance from the third hinge which is substantially equal to a second distance between the inner face of the first cover and the inner face of the second cover. A fastening means, (e.g.) hooks and complementary eyes, is provided between the surface and the inner face of the cover.

In a preferred form of the device, a flap, having an outside face and an inside face, is connected to the closure by a fourth hinge which is substantially parallel to the third hinge. Thus, when the binder is closed, the edge of one of the covers remote from the spine rests on the closure. The flap is then folded over the edge and pressed down on the outer face of the cover. Since the cover rests on the ledge (rather than on the paper secured by the rings), and the distance between the upper surface of the ledge and the inner surface of the other face is the same as the width of the spine, the binder always maintains a rectangular cross-section, regardless of the amount of paper contained therein.

In another embodiment of the present invention, the flap, resting on the surface, folds under the edge of one of the covers. The cover closes over the flap and there may be a fastening means between the inner face of the cover and the outside face of the flap. The fastening means may be of almost any type, but hooks and complementary eyes (popularly known under the trademark Vel-Cro) are preferred.

In the accompanying drawings, constituting a part hereof, and in which like reference characters indicate like parts, FIG. 1 is a schematic, cross-sectional view of the binder of the present invention in a partially open position;

Figure 1:
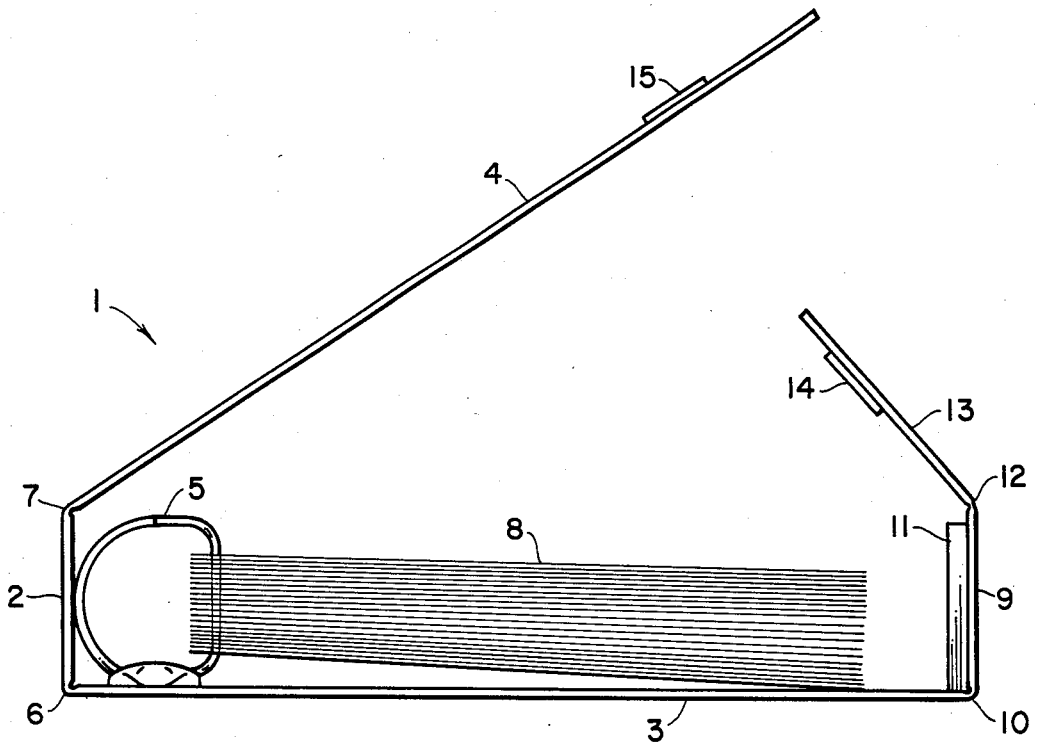

Binder 1 comprises spine 2 having first cover 3 connected thereto at a first edge by first hinge 6. Second cover 4 is connected to the other edge of spine 2 by hinge 7. Rings 5 are located on spine 2 between the inner faces of covers 3 and 4. Perforated sheet material such as paper 8 is secured by rings 5 between covers 3 and 4.

On the edge of cover 3 remote from spine 2 and rings 5, third hinge 10 connects cover 3 with closure 9. Ledge 11 is mounted on closure 9. The distance between the upper surface of ledge 11 and the inner face of cover 3 is preferably substantially the same as the distance between the inner faces of covers 3 and 4 adjacent spine 2. In this way, it is assured that covers 3 and 4 are parallel whenever binder 1 is in its closed position, regardless of the amount of paper 8 present.

Flap 13 is connected to closure 9 by hinge 12. The inner face of flap 13 overlies the outer face of cover 4, thereby closing the binder completely. Preferably, fastening means is provided between flap 13 and cover 4. Specifically, hooks 14 are affixed to the inner face of flap 13 and complementary eyes 15 are affixed to the outer face of cover 4. In this manner, binder 1 is totally secured. Of course, any suitable means can be used; e.g. snap fasteners, string, etc.

Figure 3:
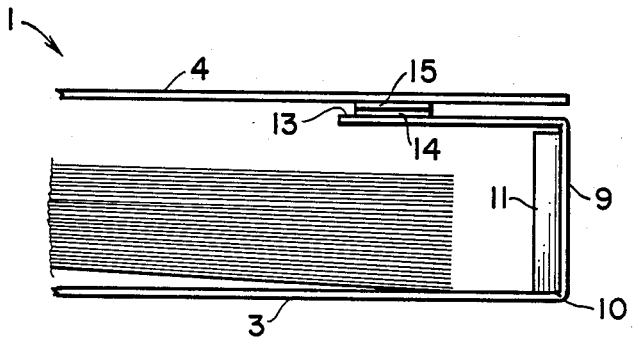
FIG. 3 is a fragmentary view, similar to that of FIG. 1, of another embodiment of the present invention.

In FIG. 3, a modification of the invention is shown. Closure 9 is somewhat shorter than the width of spine 2 and folds under (rather than over) cover 4. Hooks 14 are affixed to the outer face of flap 13 and complementary eyes 15 are affixed to the inner face of cover 4. Flap 13 (and hence cover 4) is supported by ledge 11, thereby completing the closure of binder 1. In a preferred form of this embodiment, closure 9 is somewhat shorter than the width of spine 2; most preferably, the length of closure 9 plus the thickness of flap 13 should approximately equal the width of spine 2.

Figure 4:
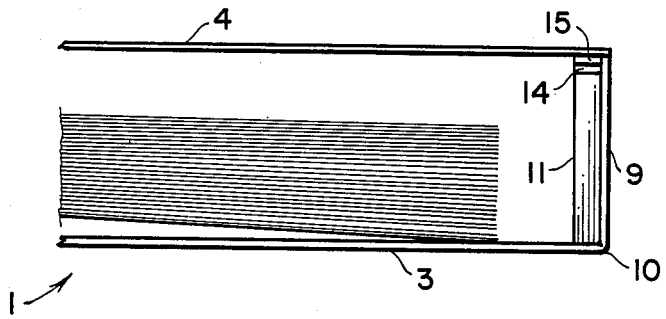
FIG. 4 is a view similar to that of FIG. 3 of a still further embodiment of the present invention.
Figure 5:
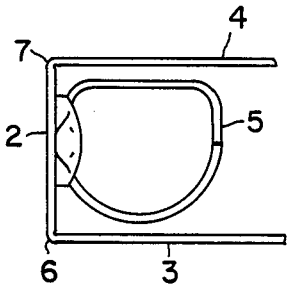
FIG. 5 is a fragmentary view of a portion of FIG. 2 showing the retaining rings on the spine.
Figure 6:
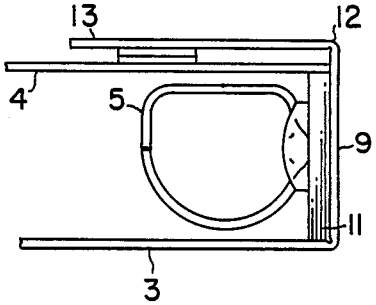
FIG. 6 is a view similar to that of FIG. 5 of the other end of FIG. 2, showing the rings on the closure.

In the embodiment shown in FIG. 4, the edge of cover 4 rests directly on the surface of ledge 11 and the fastening means is provided therebetween. Specifically, hooks 14 are affixed to the surface of ledge 11 and complementary eyes 15 are affixed to the inner face of cover 4. In this embodiment, flap 13 is eliminated as being unnecessary.

Figure 2:
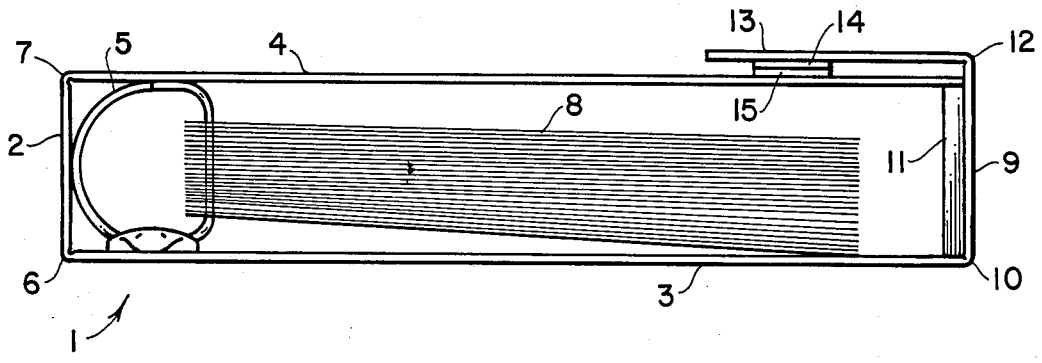
FIG. 2 is a view similar to that of FIG. 1, with the binder in the closed position.

In operating binder 1 as shown in FIGS. 1 and 2, rings 5 are opened and paper 8 is inserted and/or removed. Cover 4 is closed so that the portion of its inner face remote from spine 2 rests on the upper surface of ledge 11. Closure 9 is brought into the vertical position and flap 13 is placed over the outer face of cover 4 and secured by hooks 14 and eyes 15. In a preferred form of this embodiment of the device, the width of closure 9 is somewhat greater than the width of spine 2. The difference being sufficient to accommodate the thickness of cover 4.

In operating the device as shown in FIG. 3, paper 8 is inserted and/or removed as in the other embodiments. However, flap 13 is then closed and rests on the surface of ledge 11 which is broad enough to support it in a substantially horizontal position as shown in FIG. 3. Cover 4 is then closed so that it overlies flap 13. Hooks 14 and complementary eyes 15 serve to secure cover 4 to flap 13 and thereby maintain binder 1 in its closed position. If further securement is desired, hooks and complementary eyes can be placed on the upper surface of ledge 11 and the mating inside face of flap 13. As previously indicated, the length of closure 9 is shorter than in the other embodiments in order to allow for the thickness of flap 13. This permits covers 3 and 4 to be maintained in substantially parallel relationship when the binder is closed.

In operating the embodiment as shown in FIG. 4, after paper 8 is inserted and/or removed as previously described, cover 4 is closed so that its edge rests on the surface of ledge 11. The surface is, in a preferred form of this embodiment, provided with hooks 14 and the corresponding edge of cover 4 carries complementary eyes 15, whereby cover 4 is releasably secured to ledge 11 and binder 1 is retained in its closed position.

While the closure has been described as being located at the edge of the cover remote from the spine, this need not be so. The closure can be located on the edges of the cover which extend outwardly from the spine. If desired, two such closures can be provided, one on each of the perpendicular edges.

Moreover, the rings or the covers, can be secured to the closure rather than the spine and, as previously indicated, any form of releasable retaining means can be used in place of the ring. The invention is useful so long as the width of the spine is substantially greater than the total thickness of the sheets being held. These and other variations which are apparent to the person of ordinary skill in the art may be made without departing from the scope or spirit of the present invention. Although only a limited number of embodiments have been specifically described, the invention is, nonetheless, to be broadly construed and not to be limited except by the character of the claims appended hereto.

What I claim is:

1. A binder comprising a first cover, having an inner face and an outer face, connected to a spine by a first hinge at a first edge of said spine, a second cover, having an inner face and an outer face, connected to said spine by a second hinge at a second edge of said spine remote from and parallel to said first edge, a releasable retaining means located between the inner face of said first cover and the inner face of said second cover when said binder is in closed position and adapted to receive and retain sheets of material thereon, a closure connected to said first cover by a third hinge at an outside edge thereof, a ledge carried by said closure and having an upper surface, said upper surface located at a first distance from said third hinge substantially equal to the width of said spine, said width being greater than the total thickness of said sheets, whereby a portion of the inner face of said second cover abuts said surface and said first and second covers are substantially parallel to each other when said first cover, said second cover, and said closure are in the closed position.

2. The binder of claim 1 wherein said ledge is of substantial thickness and bears against said closure and said first cover.

3. The binder of claim 2 wherein said ledge extends from said surface to said first cover.

4. The binder of claim 2 wherein said retaining means is at least one ring and said sheets are correspondingly perforated.

5. The binder of claim 2 wherein said third hinge is remote from and substantially parallel to said first hinge or said second hinge.

6. The binder of claim 2 wherein there is provided a flap, having an outside face and an inside face, connected to said closure by a fourth hinge which is substantially parallel to said third hinge, said inside face of said flap adapted to overlie the adjacent outer face of said second cover.

7. The binder of claim 2 wherein said edge of said second cover and said surface are releasably fastened together.

8. The binder of claim 7 wherein one of said portion and said surface bears a plurality of hooks and the other of said portion and said surface bears a plurality of complementary eyes.

9. The binder of claim 1 wherein said third hinge is remote from and substantially parallel to said first hinge or said second hinge.

10. The binder of claim 9 wherein said retaining means is at least one ring and said sheets are correspondingly perforated.

11. The binder of claim 9 wherein said retaining means is on said spine.

12. The binder of claim 9 wherein said retaining means is on said closure.

13. The binder of claim 9 wherein said retaining means is a plurality of rings.

14. The binder of claim 9 wherein said retaining means is on said inner face of said first or second cover.

15. The binder of claim 14 wherein said retaining means is adjacent said spine.

16. The binder of claim 9 wherein said portion of said second cover and said surface are releasably fastened together.

17. The binder of claim 16 wherein one of said portion and said surface bears a plurality of hooks and the other of said portion and said surface bears a plurality of complementary eyes.

18. The binder of claim 9 wherein there is provided a flap, having an outside face and an inside face, connected to said closure by a fourth hinge which is substantially parallel to said third hinge, said inside face of said flap adapted to overlie the adjacent outer face of said second cover.

19. The binder of claim 18 wherein a fastening means is provided on said flap, whereby said flap is releasably secured to said adjacent outer face.

20. The binder of claim 19 wherein said fastening means comprises one of said inner face of said flap and said adjacent outer face of said second cover bearing a plurality of hooks and the other of said inner face of said flap and said outer face of the second cover bearing a plurality of complementary eyes.

21. The binder of claim 18 wherein the fourth hinge is located at a second distance from the inner face of said first cover said second distance being greater than said width.

22. The binder of claim 21 wherein said second distance is substantially equal to said width plus the thickness of said second cover.

23. The binder of claim 21 wherein a fastening means is provided on said flap, whereby said flap is releasably secured to said adjacent outer face.

24. The binder of claim 23 wherein said fastening means is a snap fastener.

25. The binder of claim 23 wherein said fastening means comprises one of said inner face of said flap and said adjacent outer face of said second cover bearing and a plurality of hooks the other of said inner face of said flap and said outer face of the second cover bearing a plurality of complementary eyes.

26. A binder comprising a first cover, having an inner face and an outer face, connected to a spine by a first hinge at a first edge of said spine, a second cover, having an inner face and an outer face, connected to said spine by a second hinge at a second edge of said spine remote from and parallel to said first edge, a releasable retaining means located between the inner face of said first cover and the inner face of said second cover when said binder is in closed position and adapted to receive and retain sheets of material thereon, a closure connected to said first cover by a third hinge at an outside edge thereof, a ledge on said closure having an upper surface, said upper surface located at a first distance from said third hinge substantially equal to the width of said spine, said width being greater than the total thickness of said sheets, a flap, having an outside face and an inside face, connected to said closure by a fourth hinge which is substantially parallel to said third hinge, a part of said inside face of said flap overlying said surface, a portion of the inner face of said second cover overlying at least some of the outside face of said flap, whereby said first and second covers are substantially parallel to each other when said first cover, said second cover, and said closure are in the closed position.

27. The binder of claim 26 wherein one of said portion and said outside face of said flap bears a plurality of hooks and the other of said portion and said outside face of said flap bears a plurality of complementary eyes.

28. The binder of claim 26 wherein said ledge is of substantial thickness and bears against said closure and said first cover.

29. The binder of claim 28 wherein said ledge extends from said surface to said first cover.

30. The binder of claim 28 wherein said retaining means is at least one ring and said sheets are correspondingly perforated.

31. The binder of claim 28 wherein said portion and said outside face of said flap are releasably secured to each other.

32. The binder of claim 28 wherein one of said portion and said outside face of said flap bears a plurality of hooks and the other of said portion and said outside face of said flap bears a plurality of complementary eyes.

33. The binder of claim 26 wherein said third hinge is remote from and substantially parallel to said first hinge or said second hinge.

34. The binder of claim 33 wherein said retaining means is at least one ring and said sheets are correspondingly perforated.

35. The binder of claim 33 wherein said portion and said outside face of said flap are releasably secured to each other.

36. The binder of claim 35 wherein said portion and said flap are releasably secured by a snap fastener.

37. The binder of claim 33 wherein said fourth hinge is at a second distance from said inner face of said first cover, said second distance being less than said width.

38. The binder of claim 37 wherein said width is approximately equal to said second distance plus the thickness of said flap.

* * * * *